United States Patent [19]

Bender et al.

[11] Patent Number: 5,031,376

[45] Date of Patent: Jul. 16, 1991

[54] RETAINING WALL CONSTRUCTION AND BLOCKS THEREFORE

[76] Inventors: Eugene M. Bender, 39 Homewood Avenue; Steve C. Bender, 31 Homewood Avenue, both of Tavistock, Ontario, Canada, N0B 2R0; Mark T. Bender, R.R. #2, New Hamburg, Ontario, Canada, N0B 2G0; Willard L. Bender, R.R. #1, Tavistock, Ontario, Canada, N0B 2R0

[21] Appl. No.: 282,046

[22] Filed: Dec. 9, 1988

[30] Foreign Application Priority Data

Feb. 25, 1988 [CA] Canada ..... 559826

[51] Int. Cl.[5] ..... E04C 2/04

[52] U.S. Cl. ..... 52/609; 52/608; 52/593

[58] Field of Search ..... 52/594, 593, 98, 100, 52/604, 608, 609

[56] References Cited

U.S. PATENT DOCUMENTS

| | | | |
|---|---|---|---|
| 1,330,884 | 2/1920 | McDermott | 52/98 X |
| 4,651,485 | 3/1987 | Osborne | 52/594 X |
| 4,711,606 | 12/1987 | Leling | 52/608 X |
| 4,860,505 | 8/1989 | Bender | 52/593 X |

FOREIGN PATENT DOCUMENTS

| | | | |
|---|---|---|---|
| 941626 | 2/1974 | Canada . | |
| 130921 | 1/1985 | European Pat. Off. | 52/593 |
| 2719107 | 11/1978 | Fed. Rep. of Germany | 52/593 |
| 459942 | 3/1950 | Italy | 52/593 |
| 678160 | 8/1979 | U.S.S.R. | 52/593 |
| 536434 | 1/1940 | United Kingdom | 52/593 |
| 537153 | 2/1941 | United Kingdom | 52/594 |

*Primary Examiner*—David A. Scherbel
*Assistant Examiner*—Creighton Smith
*Attorney, Agent, or Firm*—Wenderoth, Lind & Ponack

[57] ABSTRACT

A construction block adapted to interact with other like blocks has a body substantially in the shape of a rectangular parallelepiped having a first bearing face, a second bearing face opposite the first bearing face, two sides faces and two end faces. The first bearing face is provided, at one end thereof, with a transverse upstanding ridge, and the second bearing face is provided at the same end, with a transverse notch of less width than the ridge. When the blocks are assembled in courses to produce a retaining wall, the notch of the block of one course is adapted to nest with the inboard side of the ridge of a block in an adjacent course whereby the blocks of one course interact with the blocks of the adjacent course to resist pressure exerted by the earth or soil to be retained, and the resulting retaining wall slopes slightly from the vertical toward the earth or soil being retained. Preferably, the ridge is trapezoidal in cross section, and the notch is constituted by a bevel.

24 Claims, 4 Drawing Sheets

RETAINING WALL CONSTRUCTION AND BLOCKS THEREFORE

BACKGROUND OF THE INVENTION

This invention relates to the construction of retaining walls and to unique blocks used in the construction of such walls.

Retaining walls are frequently used in residential or business landscaping to contain raised lawn or garden areas, particularly around walkways and driveways, but also in the creation of multi-levelled or terraced lawn or garden areas. For most applications, the height of such retaining walls is not great, and this invention is directed primarily to such retaining walls having a maximum height of about 1 to ½ meters, although the invention may have application to retaining walls of greater height depending upon the size and weight of blocks used in the construction of such walls.

There are a variety of interlocking or interacting blocks currently available for use in the construction of such retaining walls. Such blocks are usually designed so that a number of courses composed of similarly shaped blocks may be arranged one atop the other in such a way that the blocks of one course interlock or interact with blocks of the adjacent courses to produce a retaining wall which exhibits a relatively high degree of resistance to outward pressure exerted by the earth or soil being retained, and which, preferably, has an external or visible face or surface which deviates slightly from the vertical, sloping upwardly and inwardly toward the earth or soil being retained. Blocks used in the construction of such retaining walls are normally formed of cast concrete, and many of the blocks currently available are suitable for their intended purpose. However, such blocks are suitable for use in only one orientation. In other words, when the blocks are arranged to construct a retaining wall, the currently available blocks are designed for use only with a given face down, the opposite face up, one end face directed outwardly to form a visible wall surface, and the opposite end face directed inwardly toward the earth or soil being retained. With a given block therefore, only one external surface texture is possible. If the particular block in question has a smooth outwardly facing end surface, such block may be used only to produce a wall having a smooth visible face. If another surface texture is desired, such as a texture simulating natural cut stone, a different block, having an outwardly facing end surface resembling natural cut stone must be employed.

SUMMARY OF THE INVENTION

Accordingly, it is an object of the present invention to provide a construction block suitable for the production of retaining walls or the like, which, in one orientation, may be used to produce a retaining wall having a smooth visible face, and, which, in another orientation, can be used to produce a retaining wall having a visible face which resembles, in texture, natural cut stone.

It is a further object of the invention that such construction blocks be of substantially identical configuration, and that, when arranged in either orientation, to construct a retaining wall, the blocks will interlock or interact to resist outward pressure exerted by the earth or soil being retained, and the outer, visible surface of the retaining wall will deviate from the vertical, sloping inwardly toward the earth or soil being retained.

The foregoing objects are achieved in accordance with the invention which, in a broad aspect, resides in a construction block adapted to interact with other like blocks comprising, a body substantially in the shape of a rectangular parallelepiped having a first bearing face, a second bearing face opposite said first bearing face, two side faces and two end faces. The first bearing face is provided, at one end thereof, with a transverse upstanding ridge, and the second bearing face is provided, at the same end, with a transverse bevel means. When the blocks are assembled in courses to produce a retaining wall, the bevel means in the block of one course is adapted to nest with the inboard side of the ridge of a block in an adjacent course whereby the blocks of one course interact with the blocks of the adjacent course to resist pressure exerted by the earth or soil to be retained, and the resulting retaining wall slopes slightly from the vertical toward the earth or soil being retained. Preferably, the ridge is of trapezoidal cross section, and the bevel means comprises a bevel of less width than the ridge.

One end face of such blocks may be provided with a surface texture different from the opposite end face so that, when the blocks are arranged in one orientation, for example, with the first bearing face directed down, the outer or visible surface of the retaining wall will exhibit one texture, and, when the blocks are arranged in the opposite orientation, for example with the first bearing face directed up, the outer visible surface of the wall will exhibit a different surface texture.

Preferably, one end face of the construction block in accordance with the invention will be smooth, whereas the opposite end face will be rough to simulate natural cut stone to make two sharply contrasting visible wall surfaces possible with the use of a plurality of like blocks.

Such blocks are readily produced from a dual block which is separable into two like construction blocks. Such dual block will exhibit a body substantially in the shape of a rectangular parallelepiped symmetrical about a transverse central plane and having a first bearing face, and second bearing face opposite thereto, two side faces and two end faces. Upstanding transverse ridges are disposed at each end of the first bearing face and a transverse bevel means is disposed at each end of the second bearing face. Transverse grooves are disposed in the first and second bearing faces in the transverse central plane of the dual block whereby the dual block may be split along the central plane into two like individual construction blocks. Preferably, the ends of the dual block are smooth, and, when split along the transverse central plane, a rough end surface will be produced in the two individual blocks so created so that two like construction blocks will be produced, each having a smooth face at the end adjacent the ridge and bevel, and each having a rough surface simulating natural cut stone at the opposite end.

DESCRIPTION OF DRAWINGS

In drawings, which illustrate the invention.

DETAILED DESCRIPTION OF THE INVENTION

Figure 1:
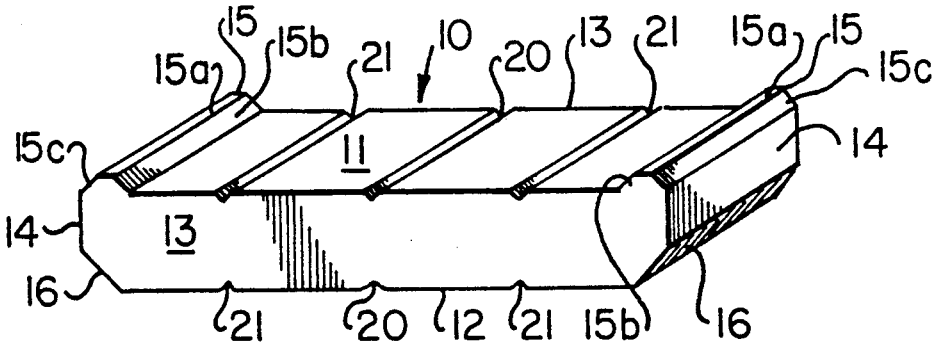
FIG. 1 is a pictorial view of a dual block in accordance with the invention.
Figure 2:
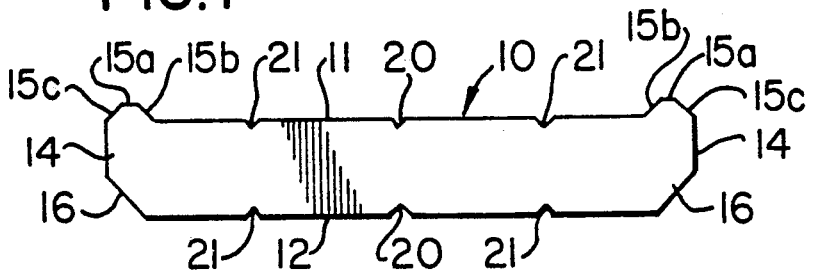
FIG. 2 is a side view of the dual block of FIG. 1.

Referring now to the drawings, FIGS. 1 and 2 illustrate a dual block 10 conventionally formed of cast concrete and having a first bearing face 11, a second bearing face 12, two side faces 13 and two end faces 14. Disposed at each end of the first bearing face 11 are ridges 15, and disposed at each end of the second bearing face 12 are bevel means, here shown in the form of flat bevels 16. Each ridge is trapezoidal in cross-section, and comprises a top face 15*a* and sloping inner and outer side or lateral faces 15*b* and 15*c*.

The bevel 16 forms an angle of 45° to the plane of the second bearing face and the end face, and the sloping side or lateral surfaces 15*b* and 15*c* of the ridge also form an angle of 45° with the plane of the first bearing face.

While the ridges and bevel means may be of rectangular cross section, the trapezoidal and bevelled forms are preferred for ease of casting and because tolerances are less demanding.

Along a central transverse plane of symmetry of the dual block is disposed, in the first and second bearing faces, a V-shaped splitting groove 20 and midway between the center plane of symmetry and each end of the dual block are disposed, in the first and second bearing faces, additional splitting grooves 21.

Figure 3:
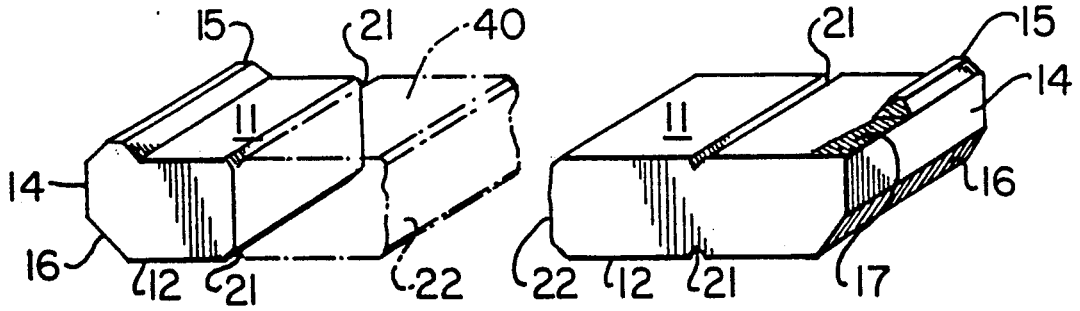
FIG. 3 is a pictorial view partially in phantom and partially broken away showing the dual block of FIG. 1 separated into two like individual blocks.

FIG. 3 illustrates the dual block of FIG. 1 which has been split along the central transverse plane of symmetry by conventional means, such as a hammer and splitting tool, utilizing the splitting grooves 20 to produce two individual construction blocks which are virtually identical, but for the rough split surfaces 22 which resemble natural cut stone. A portion of the individual block to the left in FIG. 3 is shown in phantom, to illustrate that the portion may be cut or split away through grooves 21 to produce a plain filler block used in the production of outside or inside corners of a retaining wall as will hereafter be described. Further, the right-hand block illustrated in FIG. 3 is shown with the ridge 15 partially removed at 17 by conventional means such as a hammer and chisel, to produce a block of the type used in inside or outside corner construction of a retaining wall, as will hereafter be described.

Figure 4:
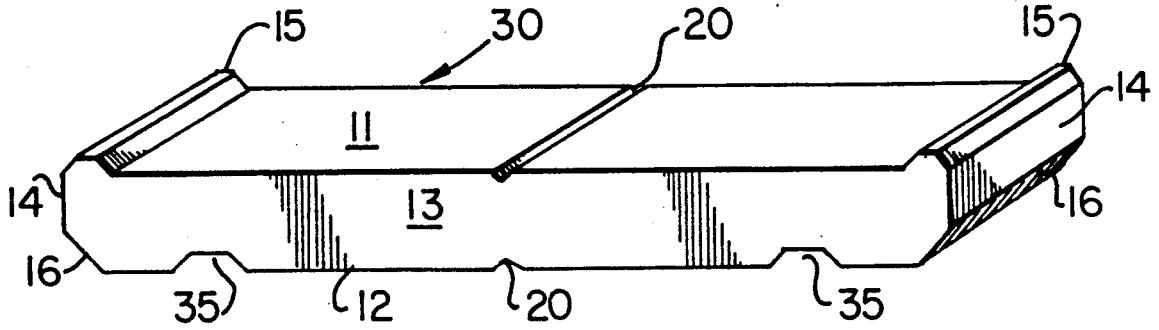
FIG. 4 is a pictorial view of an alternative form of dual block.

FIG. 4 illustrates another embodiment of a construction block 30 which is essentially the same as that depicted in FIG. 1, but which is of greater length and omits the grooves 21, but includes transverse grooves 35 of trapezoidal cross-section similar in configuration to ridges 15, but of slightly greater dimensions so they can readily accept ridges 15. This will ensure that the blocks rest upon one another with their main bearing faces in contact, and that there is sufficient tolerance to permit the construction of retaining walls which exhibit slight concave or convex curvature on their outer faces. In other respects, this block is the same as that depicted in FIG. 1, and like reference numerals are utilized to designate corresponding elements. Like the dual block 10 of FIG. 1, the dual block 30 of FIG. 4 may be separated into individual blocks by splitting through the transverse plane of symmetry utilizing splitting grooves 20.

While end faces 14 of the dual blocks of either FIG. 1 or FIG. 4 may exhibit any desired surface texture, normally the end faces will be smooth to contrast with the rough texture of end faces 22 of the individual blocks created by splitting the dual block along the transverse central plane of symmetry.

Figure 5:
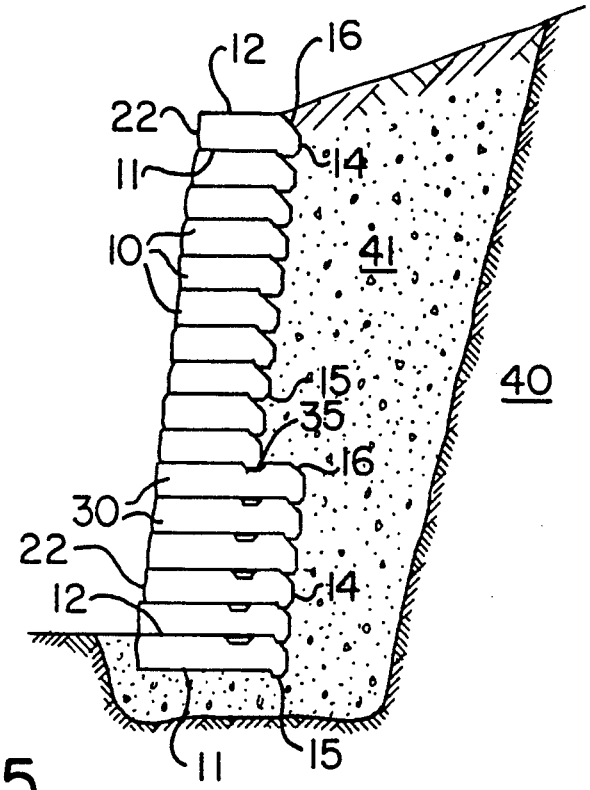
FIG. 5 is a side view, partially in section, through a retaining wall composed of individual blocks in one orientation to produce a visible surface having a surface simulating a rock face.
Figure 6:
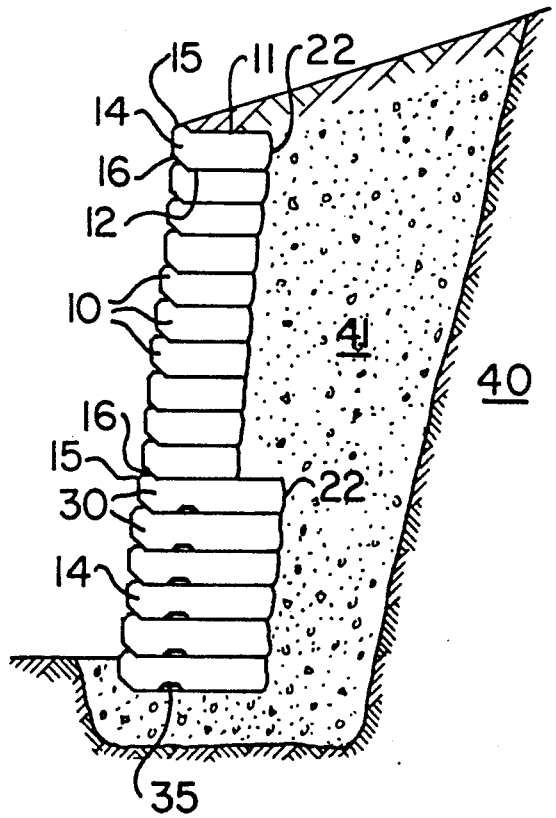
FIG. 6 is a side view, partially in section, through a retaining wall composed of individual blocks disposed in another orientation to produce a visible surface having a smooth face.
Figure 7A:
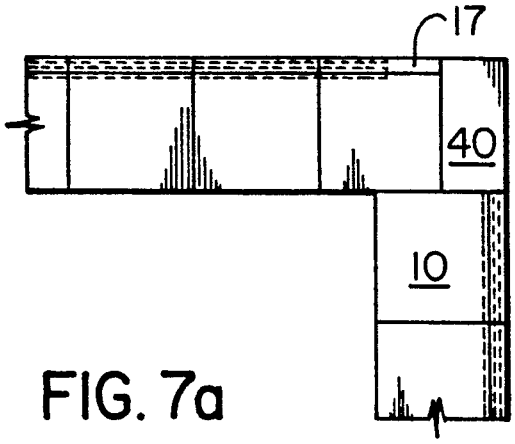
FIGS. 7*a* and 7*b* and plan views of adjacent courses of a rock face wall illustrating inside corner detail.
Figure 7B:
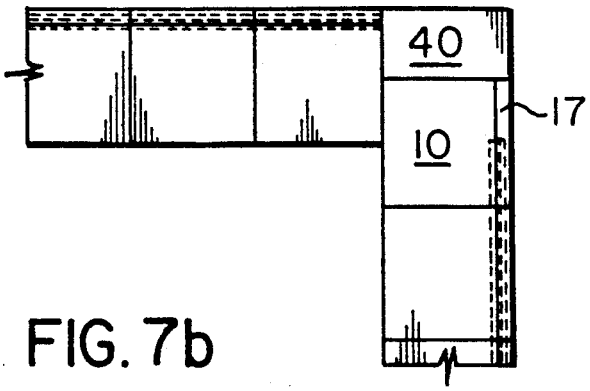
Figure 8A:
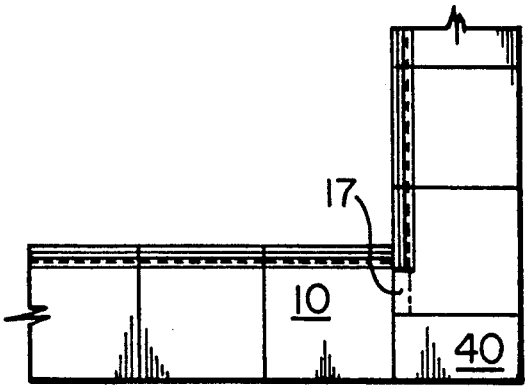
FIGS. 8*a* and 8*b* are plan views of adjacent courses illustrating inside corner details of a smooth face wall.
Figure 8B:
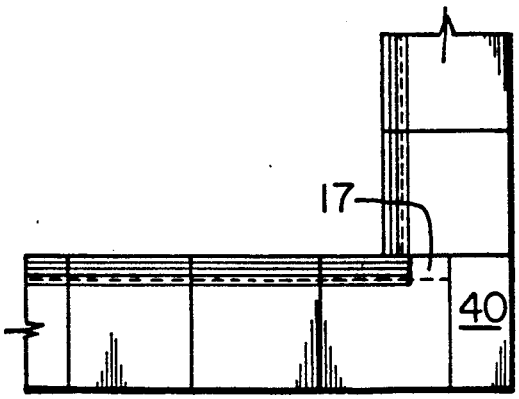
Figure 9A:
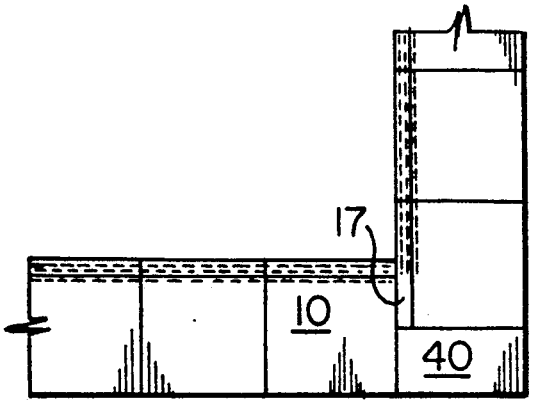
FIGS. 9*a* and 9*b* are plan views of adjacent courses illustrating outside corner details of a rock face wall.
Figure 9B:
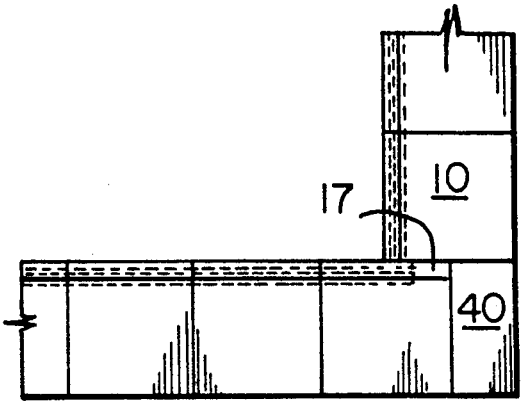
Figure 10A:
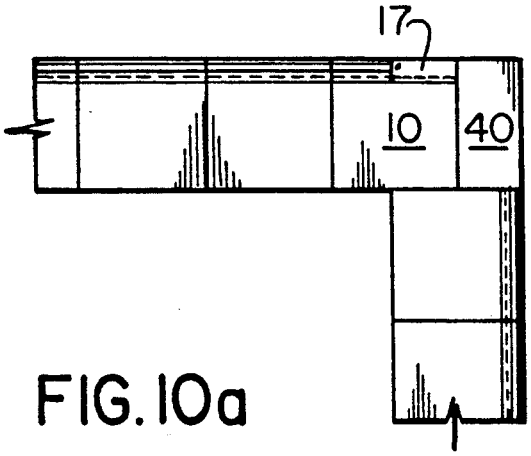
FIGS. 10*a* and 10*b* are plan views of adjacent courses illustrating outside corner details of a smooth face wall.
Figure 10B:
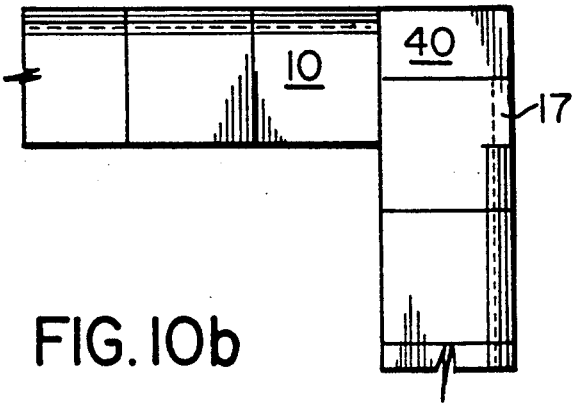

FIGS. 5 and 6 illustrate the construction of a retaining wall utilizing the individual blocks 10 as illustrated in FIGS. 1, 2 and 3 and individual blocks 30 illustrated in FIG. 4. It will be appreciated, that because of their greater length, and therefore greater weight, the individual blocks 30 are used to form the lower base portion of the retaining wall, whereas the individual blocks 10 are used to form the upper courses of the retaining wall. It will also be appreciated, that a retaining wall could be produced entirely utilizing the individual blocks 10. However, the use of the heavier blocks 30 permits a retaining wall of somewhat greater height to be produced than would otherwise be possible utilizing only the smaller individual blocks 10. For example, the smaller blocks alone would be useful to produce a retaining wall of approximately 1 meter in height, unless a retaining wall of up to about 1½ meters can readily be produced utilizing a combination of individual blocks 30 to form the base of the wall and individual blocks 10 to form the upper courses.

The retaining wall depicted in FIG. 5 is in the nature of a rock face wall. In other words, the rough end faces 22, created by splitting the dual blocks 10 or 30, face outwardly, and the first bearing face of each block faces downwardly with the ridge of each block in the immediately adjacent upper course being hooked behind the bevel on the second bearing face of the block below so that the inner side face of the ridge of the upper block nests with the bevel of the lower block and the blocks interlock or interact to resist outer pressure from the original soil 40 or the crushed fill 41 inserted below and behind the retaining wall and between the retaining wall and the original soil.

It will be apparent that the shorter blocks 10 will not, in construction of the rock face wall depicted in FIG. 5, interact with the foundation blocks 30, because of the difference in length between blocks 10 and 30. Accordingly, the trapezoidal grooves 35 are appropriately formed in the second bearing face of blocks 30 to receive ridge 15 of blocks 10 to provide the necessary interlock and interaction between the two types of block at their interface, while retaining the near vertical slope of the outer face of the wall. It will also be apparent that the blocks 10 and 30 are so dimensioned that, in the rock face wall constructions depicted in FIG. 5, the nesting of the inner face of ridge 15 with the bevel 16 of the block immediately below will result in face 22 of the upper block being inset slightly from face 22 of the block immediately below to result in an outer wall surface deviating slightly from the vertical, and sloping slightly inwardly toward the soil be retained.

FIG. 6 illustrates the construction of the retaining wall, utilizing blocks identical to those utilized in FIG. 5, but having the smooth end faces 14 directed outwardly to form the visible retaining wall surface, which will here be described as a smooth face wall, with the rough surfaces 22 resembling natural cut stone, formed from splitting of the dual block, directed inwardly toward the soil being retained.

In the smooth face wall constructing depicted in FIG. 6, it will be seen that the orientation of the blocks 10 and 30 are reversed in that the first bearing face 11 is now directed upwardly, the second bearing face 12 is directed downwardly, the smooth end 14 is directed outwardly to form the visible retaining wall surface, and the rough surfaced end 22 is directed inwardly toward the soil being retained. The blocks still interlock to resist the outward pressure of the soil 40 being retained, as the inner face of each ridge 15 nests with bevel 16 of the block immediately above, including the interface between blocks 10 and 30. Again, the blocks are so dimensioned that, when arranged as depicted in FIG. 6, the outer surface of the wall deviates slightly from the vertical, sloping slightly inwardly toward the soil being retained.

To construct a retaining wall as depicted in either 5 or 6 one should excavate for footing to a minimum depth of 250 millimeters below finished grade at the front of the wall, or until firm original soil is reached. The excavation should allow for the thickness of the wall plus a minimum depth of 250 millimeters to allow for compacted crushed granular back fill behind the wall. Crushed granular material should then be placed within the footing excavation and compacted in maximum 150 millimeter layers to provide a firm wall base. The first course of blocks should then be placed and levelled so that the top of the course is flush with the desired finished grade in front of the wall. Of course the dual blocks must be split with hammer and chisel, or similar splitting tool, along the transverse central plane of symmetry. Either end face can be exposed simply by reversing the block as depicted in either FIGS. 5 or 6. Slight spaces may be left between certain of the blocks near the base of the wall for drainage and of course the blocks should be displaced a distance of about one half the width of each block from course to course in the conventional manner of laying conventional bricks or retaining wall blocks. As the height of the wall increases with the addition of each course of blocks, the space behind the retaining wall and between the back of the retaining and the original soil 40 should be back filled with suitable granular fill 41 ensuring that the material used for the backfill is adequately compacted as the work proceeds. When the wall is complete, the backfill material may be covered with topsoil and landscaped to promote surface water runoff over the top of the wall.

FIGS. 7, 8, 9 and 10 each illustrate adjacent courses of blocks 10 arranged to form an inside corner of a rock face wall, an inside corner of a smooth face wall, an outside corner of a rock face wall, and an outside corner of a smooth face wall respectively. It will be seen that half blocks 40, as depicted in FIG. 3, are utilized to fill in corner areas where spaces have been left as a result of the staggered half block arrangement of blocks 10 from course to course. Further, it will be noted that sections of the ridges 15 have been removed as shown in FIG. 3 to avoid interference, particularly with the filler blocks 40, in the corner areas.

While the blocks may be made in any suitable size, a typical individual block 10 for ordinary usage will have a length from end 14 to end 22 of 300 millimeters, a width between sides 13 of 300 millimeters, and a thickness from the first bearing face 11 to the second bearing face 12 of 100 millimeters. Of course in the dual block unit depicted in FIGS. 1 and 2, the total length of the unit from one end face 14 to the other end face 14 will be 600 millimeters (double the length of an individual block) and the grooves 20 will be disposed in the central transverse plane at a distance of 300 millimeters from either end, with the grooves 21 being disposed midway the grooves 20 and each end face 14, at a distance of 150 millimeters from each end face. The ridges have a width at the base (at the first bearing surface 11) of 44 millimeters and a height of 16 millimeters. The bevels 16 have a depth of 37 millimeters, i.e., the distance from the imaginary corner of the block formed by the plane containing end face 14 and the plane containing the second bearing face 12 to the respective bevel edge is 37 millimeters.

The larger blocks 30, used for base construction have a total length of 900 millimeters and a half length, when split along grove 20, of 450 millimeters. The grooves 35 have a depth of 18 millimeters and a width, at face 12, of 75 millimeters.

The foregoing dimensions provide sufficient tolerance, as between grooves 35 and ridges 15 to permit the construction of retaining walls with a degree of curvature, either convex or concave. Further, these dimensions result in a 7 millimeter setback or inset as between the outer face of a block 10 in one course and the outer face of a block 10 in the course immediately above.

While obviously the foregoing dimensions may be varied depending upon the size and weight of blocks desirable for any particular purpose, the relationship between the bevel 16 and ridges 15 should be such that, when the bevel 16 nests with the inboard lateral surface **15*b* of ridge 15**, the outer face of the wall so formed will have an appropriate deviation from the vertical, with a slight incline toward the soil being retained.

As will be apparent from the foregoing, the novel construction block in accordance with the invention permits, with the utilization of a single block form, retaining walls to be produced which at the option of the builder, exhibit a visible wall surface having a smooth texture, or a rough texture resembling that of natural cut stone. This is accomplished simply by reversing the orientation of the individual blocks when constructing the different wall forms, and, regardless of the orientation selected and the wall form desired, the blocks of adjacent courses will interlock or interact to resist the outward pressure exerted by the soil and aggregate material being retained. By appropriate dimensioning of the blocks, and particularly the ridges and bevels, the completed wall may have any predetermined slope depending upon what may be considered optimum for the particular purpose for which the blocks are designed.

While different types of blocks have been illustrated, one being somewhat larger and heavier for use in forming the lower portion of a retaining wall, and the other being smaller, and hence lighter, for use in forming the upper courses of a retaining wall, it will be appreciated that, for many applications, only the smaller blocks will be required, and that retaining walls may be composed completely of the smaller blocks. The larger blocks are used primarily only when there is a requirement for a wall having somewhat greater height than should be constructed with only the smaller blocks. However, it will be appreciated, that, as the size and weight of the blocks may be varied, without varying their fundamental shape, walls of greater heights may be constructed with the use of blocks comparable to the smaller blocks, but having larger dimensions in width, length, thickness, or all three.

While the preferred embodiments of this invention have been described and illustrated, it will be appreciated that variations and departures therefrom may be obvious to those persons skilled in the particular field to which this invention relates without departing from the spirit or scope of the invention as defined in the accompanying claims.

What we claim as our invention is:

1. A construction block adapted to interact with other like blocks comprising, a body substantially in the shape of a rectangular parallelpiped having a first bearing face, a second bearing face opposite said first bearing face, two side faces and two end faces;

a single transverse upstanding ridge means on said first bearing face at one end face and having an inboard side facing toward the remainder of said body;

a single bevel means on said second bearing face between said second bearing face and said one end face;

whereby the bevel means of said block is adapted to nest with the inboard side of the ridge means of another like block when a second bearing face of said like block rests upon said first bearing face.

2. A construction block adapted to interact with other like blocks in a retaining wall system composed of a plurality of courses of said blocks arranged one above the other, comprising, a body substantially in the shape of a rectangular parallelpiped having a first bearing face, a second bearing face opposite said first bearing face, two side faces and two end faces;

a single transverse upstanding ridge means on said first bearing face at one end face and having an inboard side facing toward the remainder of said body;

a single transverse bevel means in said second bearing face at said one end face, the greatest transverse dimension of said ridge means being greater than the greatest transverse dimension of said bevel means;

whereby the notch means of said block is adapted to nest with the inboard side of the ridge means of another like block when a second bearing face of said like block lies against said second bearing face.

3. A construction block as claimed in claim 1 or 2, further comprising a further transverse groove in said second bearing face spaced inboard of said bevel means and having a shape complementary to said upstanding ridge means.

4. A construction block as defined in claim 3 wherein said ridge means comprises a ridge of trapezoidal cross-section and extends from one side face to the other side face, and said notch means comprises a bevel extending from one side face to the other side face.

5. A construction block as defined in claim 4 wherein the top and said ridge is parallel with said first bearing face and wherein the lateral surfaces of said ridge slope downwardly at an angle of 45° with respect to said top first bearing face.

6. A construction block as defined in claim 5 wherein said bevel forms an angle of 45° with said second bearing face.

7. A construction block as defined in claim 3, wherein said ridge means and said bevel means are so dimensioned that when the first bearing face of said block bears against a second bearing face of a like block in an adjacent course, the outer face of the block in the upper course will be inset from the outer face of the block in the lower course an amount corresponding to a desired slope of the outer face of the retaining wall which is at a predetermined angle to the vertical,

8. A construction block as defined in claim 5 wherein the height of said ridge is approximately half the depth of said bevel.

9. A construction block as defined in claim 8 wherein the distance between the two side faces and the distance between the two end faces is 300 millimeters, the height of said ridge is 16 millimeters, the width of said ridge at said first bearing surface is 44 millimeters, and the depth of said bevel is 37 millimeters.

10. A construction block as defined in claim 3, 7 or 9 wherein the surface texture of said one end face is different from the surface texture of the other end face.

11. A construction block as defined in claim 3, 7 or 9 wherein the surface of said one end face is relatively smooth, and the surface of said other end face is relatively rough whereby to simulate natural stone.

12. A dual block separable into two like construction blocks adapted to interact with other like blocks in a retaining wall system comprising, a body substantially in the shape of a rectangular parallelepiped symmetrical about a transverse central plane and having a first bearing face, a second bearing face opposite thereto, two side faces, and two end faces;

upstanding transverse ridges at each end of said first bearing face, said ridges being trapezoidal in cross-section;

a transverse bevel at each end of said second bearing face;

transverse grooves in said first and second bearing faces, disposed in said transverse central plane, whereby said dual block may be split into two like individual construction blocks.

13. A dual block as defined in claim 12 wherein the top surface of each ridge is parallel with said first bearing face, the lateral surfaces of said ridge slope downwardly at an angle of 45° with respect to said first bearing face, and said bevel forms an angle of 45° with said second bearing face.

14. A dual block as defined in claim 13 wherein the depth of said bevel is approximately twice the height of said ridge.

15. A dual block as defined in claim 14 wherein the length of said block is 600 millimeters, the width of said block is 300 millimeters, the width of said ridge at said first bearing face is 44 millimeters, the height of said ridge is 16 millimeters, and the depth of said bevel is 37 millimeters.

16. A dual block as defined in claim 12, 13 or 14 comprising aligned transverse grooves in said first and second bearing faces midway between said transverse central plane and said end faces.

17. A dual block as defined in claim 12, 13 or 14 comprising a transverse groove of trapezoidal cross-section inboard of each bevel, said groove being so configured as to freely receive a ridge of an individual construction block.

18. A dual block as defined in claim 12, 13 or 14 comprising a transverse groove of trapezoidal cross-section inboard of each bevel, said groove having side-walls sloping inwardly at an angle of 45° with respect to said second bearing fact, a width at said second bearing face of 75 millimeters, a depth of 18 millimeters, and said block having a length of 900 millimeters.

19. A retaining wall comprising a plurality of construction blocks adapted to interact with each other and arranged in a plurality of horizontally extending adjacent courses one above the other, each block comprising a body in the shape of a rectangular parallelepiped having a first bearing face, a second bearing face opposite said first bearing face, two side faces, and two end faces, a single outwardly projecting transverse ridge on said first bearing face at one end face, and a single transverse bevel means in said second bearing face between said second bearing face and said one end face, said blocks being arranged with outer end faces of the blocks of an upper course being rearwardly offset with respect to outer end faces of the blocks of an adjacent lower course such that the bevel means of blocks in a course nest with the inboard surface of the ridges of the blocks in an adjacent course whereby blocks in an upper coarse are restrained against outward displacement of blocks in an adjacent lower course.

20. A retaining wall as defined in claim 19 wherein said ridges are of trapazoidal cross section having a top face parallel with said first bearing face and lateral surfaces sloping at an angle of 45° with respect to said first bearing face, and wherein said notches comprise bevels on the respective blocks are at an angle of 45° with respect to said second bearing face.

21. A retaining wall as defined in claim 20 wherein said ridges and bevels are so dimensioned that the outer face of said wall deviates at a predetermined angle from the vertical.

22. A double construction block adapted to be split into two single construction blocks which interact with each other and with other like single construction blocks, comprising:

a body substantially in the shape of a rectangular parallelpiped having a first bearing face, a second bearing face opposite said first bearing face, two side faces and two end faces;

two transverse upstanding ridge means on said first bearing face, one at each end face thereof and having an inboard side facing toward the remainder of said body;

two bevel means on said second bearing face one between said second bearing face and each end face;

said body having aligned transverse grooves provided in said first and second bearing faces midway between said end faces for defining a transverse plane through said body for splitting said double construction block into two identical single construction blocks;

whereby when said double construction block is split, the bevel means of one single construction block is adapted to nest with the inboard side of the ridge means of another like single construction block when a second bearing face of said like single construction block rests upon a first bearing face of said one single construction block.

23. A double construction block as claimed in claim 22 wherein said ridge means and said bevel means are so dimensioned that when the first bearing face of one single construction block bears against a second bearing face of a like single construction block in an adjacent course of a retaining wall system having plurality of courses of single construction blocks arranged one above the other, the outer face of the single construction block in the upper course will be inset from the outer face of the single construction block in the course an amount corresponding to a desired slope of the outer face of the retaining wall system.

24. A double construction block as claimed in claim 23 wherein the height of each of said ridges is approximately half the depth of each of said bevels.

* * * * *